BEST AVAILABLE COPY

United States Patent [19]

Darolia et al.

[11] Patent Number: 5,043,138

[45] Date of Patent: Aug. 27, 1991

[54] YTTRIUM AND YTTRIUM-SILICON BEARING NICKEL-BASE SUPERALLOYS ESPECIALLY USEFUL AS COMPATIBLE COATINGS FOR ADVANCED SUPERALLOYS

[75] Inventors: Ramgopal Darolia, West Chester; Edward H. Goldman, Cincinnati, both of Ohio

[73] Assignee: General Electric Company, Cincinnati, Ohio

[21] Appl. No.: 393,111

[22] Filed: Aug. 4, 1989

Related U.S. Application Data

[63] Continuation of Ser. No. 82,902, Aug. 4, 1987, abandoned, which is a continuation of Ser. No. 890,965, Jul. 29, 1986, abandoned, which is a continuation of Ser. No. 768,928, Aug. 26, 1985, abandoned, which is a continuation of Ser. No. 565,803, Dec. 27, 1983, abandoned.

[51] Int. Cl.[5] ..... C22C 19/05

[52] U.S. Cl. ..... 420/443; 420/445; 428/614; 428/680; 106/286.4; 106/286.5

[58] Field of Search ..... 420/443, 445; 428/614, 428/680; 106/286.4, 286.5

[56] References Cited

U.S. PATENT DOCUMENTS

| | | | |
|---|---|---|---|
| 3,276,865 | 10/1966 | Fredre et al. | 420/439 |
| 3,526,499 | 9/1970 | Quigg et al. | 420/448 |
| 3,904,402 | 9/1975 | Smashey | 420/439 |
| 3,928,026 | 12/1975 | Hedt et al. | 428/615 |
| 4,054,723 | 10/1977 | Higginbothram et al. | 428/678 |
| 4,116,723 | 9/1978 | Gell et al. | 148/162 |
| 4,169,742 | 10/1979 | Wukusick et al. | 148/404 |
| 4,209,348 | 6/1980 | Duhl et al. | 420/448 |
| 4,222,794 | 9/1980 | Schweizer | 148/162 |
| 4,284,430 | 8/1981 | Henry | 420/443 |
| 4,288,247 | 9/1981 | Shaw | 420/443 |
| 4,292,076 | 9/1981 | Gigliotti et al. | 420/448 |
| 4,313,760 | 2/1982 | Dardi et al. | 428/678 |
| 4,326,011 | 4/1982 | Goebel et al. | 428/678 |

*Primary Examiner*—Stephen J. Lechert, Jr.
*Attorney, Agent, or Firm*—Jerome C. Squillaro; Carmen Santa Maria

[57] ABSTRACT

There is provided by the present invention yttrium and yttrium-silicon bearing alloys which are chemically and mechanically compatible with advanced nickel-base superalloys and nickel-base eutectic superalloys and which posses excellent resistance to high temperature oxidation. The alloys of the invention are, therefore, particularly useful as a protective environmental coatings for the external surfaces of hot-stage aircraft gas turbine engine components, e.g., rotating blades and stationary vanes, made from such advanced superalloys.

23 Claims, 3 Drawing Sheets

BEST AVAILABLE COPY

BEST AVAILABLE COPY

BEST AVAILABLE COPY

YTTRIUM AND YTTRIUM-SILICON BEARING NICKEL-BASE SUPERALLOYS ESPECIALLY USEFUL AS COMPATIBLE COATINGS FOR ADVANCED SUPERALLOYS

This is a continuation, of application Ser. No. 082,902 filed Aug. 4, 1987, abandoned, which is a continuation of application Ser. No. 890,965, filed 7/29/86, abandoned, which is a continuation, of application Ser. No. 768,928, filed Aug. 20, 1986, abandoned, which is a continuation of application Ser. No. 565,803 filed Dec. 27, 1983 now abandoned.

The Government has rights in this invention pursuant to Contract No. N00019-80-0017 awarded by the United States Department of the Navy.

CROSS-REFERENCE TO RELATED APPLICATION

The invention disclosed and claimed herein is related to the invention disclosed and claimed in patent application Ser. No. 13DV-8418, filed of even date herewith.

BACKGROUND OF THE INVENTION

This invention pertains generally to nickel-base superalloys useful in the manufacture of hot-section components of aircraft gas turbine engines, e.g., vanes and rotating blades, and more particularly to yttrium and ytrrium-silicon bearing compatible coatings especially useful for the enhancement of the environmental resistance of such hot-section components made from advanced nickel-base superalloys and nickel-base eutectic superalloys.

Vanes and rotating blades cast conventionally from nickel-base superalloys typically consist of equiaxed nonoriented grains. Recognizing the effects of grain boundaries on high temperature mechanical properties, much effort has been expended to improve the properties of such vanes and blades by strengthening the grain boundaries through the addition of grain boundary strengtheners, such as boron and zirconium, elimination of grain boundaries transverse to the major stress axis, or elimination of grain boundaries altogether.

By the use of directional solidification (DS) as is described, for example, in U.S. Pat. No. 4,202,400, which is incorporated herein by reference, it is possible to produce parts such as vanes and rotating blades having an oriented microstructure of columnar grains whose major axis is parallel to the major stress axis of the parts and which have few or no grain boundaries perpendicular to the major stress axis. A further advance has been to use directional solidification techniques to produce vanes and rotating blades as single crystals, thus eliminating high angle grain boundaries and orienting low angle grain boundaries parallel to the major stress axis while minimizing the presence of low angle grain boundaries.

Yet another advance in materials for high temperature gas turbines are the advanced nickel-base eutectic superalloys such as the monocarbide reinforced nickel-base eutectic superalloys of the type described, for example, in U.S. Pat. 4,292,076 to Gigliotti, Jr. et al., which is incorporated herein by reference. The superalloys of U.S. Pat. No. 4,292,076, when directionally solidified under stringent conditions to achieve planar front solidification, result in a eutectic composite microstructure consisting of strong, reinforcing metallic carbide (MC) fibers in a $\gamma/\gamma'$ nickel-base superalloy matrix.

Because highly aligned anisotropic microstructures are formed during planar front solidification, the superalloys of U.S. Pat. No. 4,292,076 offer potential structural stability and property retention to a greater fraction of their solidification temperatures than do other materials.

In order to take full temperature advantage of the advanced nickel-base superalloys and nickel-base eutectic superalloys, however, coatings are required to provide environmental protection at the high intended use temperatures. Stringent requirements are placed on the coatings and the coating/substrate composite. For example, the coatings must be tightly bonded, i.e., metallurgically bonded, to the substrate and ideally must not degrade either the mechanical properties of the substrate (e.g., ductility, stress rupture strength and resistance to thermal fatigue) or the chemical properties of the substrate (e.g., oxidation resistance and hot corrosion resistance).

Examples of adverse effects to eutectic superalloys which have resulted from prior art incompatible coatings are fiber denudation near the coating/substrate interface due to outward diffusion of carbon from the fibers into the coating and the formation of brittle precipitates, generally in the form of needle-like platelets, in the substrate due to interdiffusion of elements between the coating and the substrate. Similarly, zones denuded of the gamma prime ($\gamma'$) strengthening phase and formation of brittle precipitates have been observed in single crystal nickel-base superalloys due to the use of incompatible coatings.

While many coatings and barrier/coating systems have been proposed and tried, there has been a general inability in the past to specify coatings or barrier/coating systems which are truly compatible with advanced nickel-base superalloy and nickel-base eutectic superalloy substrates, i.e., offer improved environmental protection and produce good metallurgical bonds with the substrate yet not degrade the mechanical or chemical properties of the substrate.

Therefore, there exists a need for protective environmental coatings which are truly compatible with the newest generation of nickel-base superalloys and nickel-base eutectic superalloys, particularly those designed for use as vanes and rotating blades in aircraft gas turbine engines.

SUMMARY OF THE INVENTION

There is provided by the present invention two nickel-base superalloys which are chemically and mechanically compatible with advanced nickel-base superalloys and nickel-base eutectic superalloys and which possess excellent resistance to high temperature oxidation. The alloys of the invention are, therefore, particularly useful as a protective environmental coating for the external surfaces of hot stage aircraft gas turbine engine components, e.g., rotating blades and stationary vanes, made from advanced nickel-base superalloys and nickel-base eutectic superalloys.

Broadly, the yttrium-bearing superalloy of the invention consists essentially of about, by weight, 1 to 10% cobalt, 6 to 12% chromium, 5 to 8% aluminum, 1 to 10% tantalum, 1 to 10% tungsten, 0 to 3% rhenium, 0 to 2% molybdenum, 0.1 to 2% hafnium, 0.005 to 0.1% boron, 0.005 to 0.25% carbon, 0.01 to 1.0% yttrium the balance being nickel and incidental impurities.

Also, broadly, the yttrium-silicon bearing superalloy of the invention consists essentially of about, by weight, 1-10% cobalt, 6 to chromium, 5 to 8% aluminum, 1 to 10% tantalum, 1 to 10% tungsten, 0 to 3% rhenium, 0 to 2% molybdenum, 0.1 to % hafnium, 0.005 to 0.1% boron, 0.005 to 0.25% carbon, 0.01 to 10% yttrium, 0.5 to 2.5% silicon, the balance being nickel and incidental impurities.

While it is contemplated that the above-described novel superalloys will be applied most frequently as protective environmental coatings to provide at least a portion of the outer surface of gas turbine engine components and articles, it has also been found that the novel alloys of this invention are useful as thicker, built-up deposits applied to selected regions of substrates, such as aircraft gas turbine engine components, for repair purposes, or as the tip portion of rotating blades. Such applications then, contemplate composite articles of manufacture having as a substrate an article, such as a gas turbine engine airfoil, made of a nickel-base superalloy or nickel-base eutectic superalloy and one or more thick, built-up regions contiguous with, i.e., joined to and forming an integral part of, the substrate wherein the one or more regions comprise at least a portion of the outer surface of the composite article and are of one of the above-described novel superalloy compositions.

DESCRIPTION OF THE PREFERRED EMBODIMENT

Figure 1:
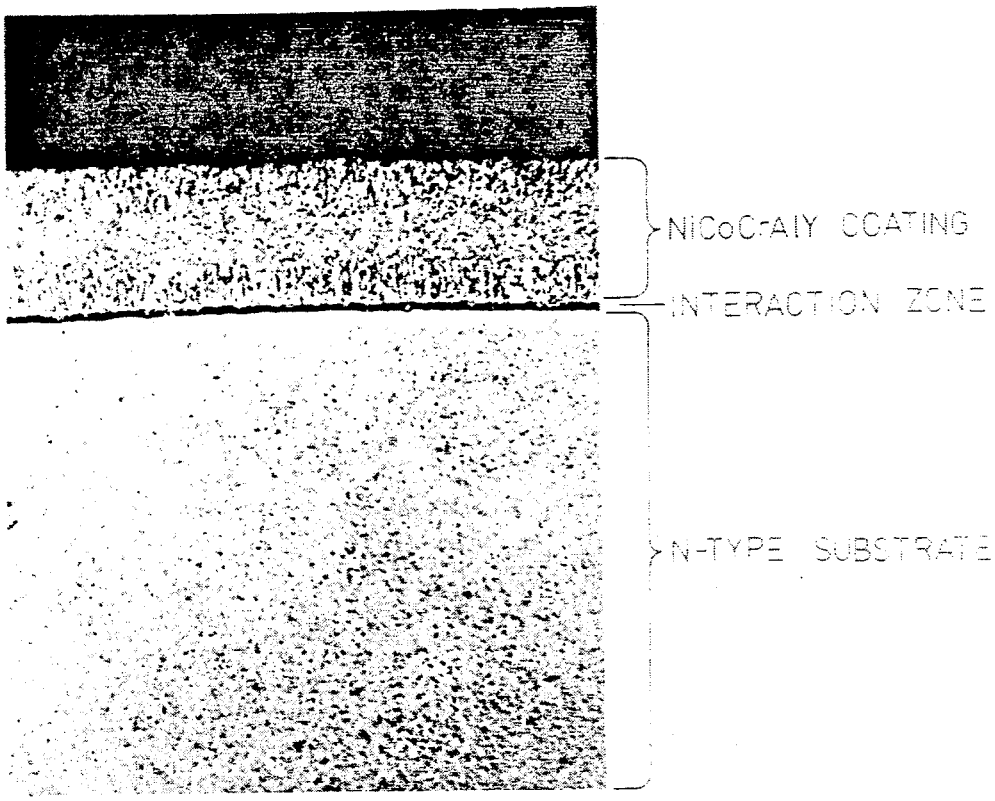
FIG. 1 is a photomicrograph at 300X of a NiCoCrAlY type coating as-deposited on an N-type nickel-base single crystal superalloy substrate.

As set forth in the foregoing summary, the present invention relates to nickel-base superalloys which are chemically and mechanically compatible with advanced nickel-base superalloys and nickel-base eutectic superalloys and which possess excellent resistance to high temperature oxidation. The yttrium-bearing superalloys of the invention consist essentially of cobalt, chromium, aluminum; tantalum, tungsten, rhenium, molybdenum, hafnium, boron, carbon and yttrium in the percentages (by weight) set forth in Table I below, the balance being nickel and incidental impurities.

TABLE I

| | ALLOY COMPOSITIONS (weight %) | | |
|---|---|---|---|
| Elements | Base | Preferred | More Preferred |
| Co | 1-10% | 1-6% | 3.8-4.2% |
| Cr | 6-12% | 7-10% | 8.3-8.7% |
| Al | 5-8% | 5-7% | 5.8-6.2% |
| Ta | 1-10% | 4-6% | 4.7-5.3% |
| W | 1-10% | 3.5-5.5% | 4.2-4.8% |
| Re | 0-3% | 0-3% | 1.2-1.8% |

TABLE I-continued

| | ALLOY COMPOSITIONS (weight %) | | |
|---|---|---|---|
| Elements | Base | Preferred | More Preferred |
| Mo | 0-2% | 0-2% | 1.3-1.7% |
| Hf | 0.1-2% | 0.5-1.5% | 0.7-1.1% |
| B | 0.005-0.1% | 0.005-0.025% | 0.005-0.02% |
| C | 0.005-0.25% | 0.005-0.25% | 0.005-0.2% |
| Y | 0.01-1.0% | 0.05-0.5% | 0.2-0.4% |

The yttrium-silicon bearing superalloy of the invention consists essentially of cobalt, chromium, aluminum, tantalum, tungsten, rhenium, molybdenum, hafnium, boron, carbon, yttrium, and silicon in the percentages (by weight) set forth in Table II below, the balances being nickel and incidental impurities.

TABLE I

| | ALLOY COMPOSITIONS | | |
|---|---|---|---|
| Elements | Base | Preferred | More Preferred |
| Co | 1-10% | 1-6% | 3.8-4.2% |
| Cr | 6-12% | 7-10% | 8.3-8.7% |
| Al | 5-8% | 5-7% | 5.8-6.2% |
| Ta | 1-10% | 4-6% | 4.7-5.3% |
| W | 1-10% | 3.5-5.5% | 4.2-4.8% |
| Re | 0-3% | 0-3% | 1.2-1.8% |
| Mo | 0-2% | 0-2% | 1.3-1.7% |
| Hf | 0.1-2% | 0.5-1.5% | 0.7-1.1% |
| B | 0.005-0.1% | 0.005-0.025% | 0.005-0.02% |
| C | 0.005-0.25% | 0.005-0.25% | 0.005-0.2% |
| Y | 0.01-1.0% | 0.05-0.5% | 0.2-0.4% |
| Si | 0.5-2.5% | 0.5-1.5% | 0.8-1.2% |

The present alloys are particularly useful as protective environmental coatings, of between about 0.002 and 0.1 inches in thickness, for the external surfaces of solid and hollow, fluid-cooled gas turbine engine components, e.g., rotating blades and stationary vanes, operating in the hot stage sections of such turbines and made from advanced nickel-base superalloys and nickel-base eutectic superalloys. While it is contemplated that the novel alloys herein described will most frequently be applied as protective environmental coatings to provide at least a portion of the outer surface of gas turbine engine components and articles, it has also been found that the superalloy of the invention is also useful as one or more thicker, built-up deposits applied to selected regions of such articles or component-like substrates.

Whether the novel alloys are deposited as coatings or thicker, built-up deposits, the utilization of plasma spray techniques to deposit the alloy of the invention is preferred. Most preferred is the technique, sometimes referred to as low pressure plasma deposition (LPPD), described in U.S. Pat. No. 3,839,618 -Muehlberger, which patent is incorporated herein by reference. Alloys in accordance with the present invention produce very dense coatings or deposits after plasma spraying and especially after plasma spraying by the above-mentioned LPPD process whereby as-deposited densities of 95% and greater are readily obtained.

The wide differences in the evaporation rates (or vapor pressures) between high vapor pressure elements like chromium, manganese or aluminum and low vapor pressure elements like tantalum or tungsten make the deposition and composition control of coatings of the novel alloys of this invention by other processes such as vacuum physical vapor deposition difficult, if not impossible. It will be appreciated, however, that process improvements or modifications in methods such as physical vapor deposition or ion plating could make coating by these methods possible, and the use of these methods is therefore contemplated. Additionally, techniques like sputtering, slurry sintering, or others may also be considered.

To illustrate the practice of the present invention, a series of coatings, hereinafter referred to as the "6MY" or 6MY-type coatings by way of designation, was produced by low pressure plasma deposition of a 6MY-type alloy of the invention, i.e., one consisting essentially of, nominally by weight within normal melting tolerances, 4% Co, 8.5% Cr, 6% Al, 5% Ta, 4.5%, 1.5% Re, 1.5% Mo, 0.9% Hf, 0.01% B, 0.05% C, and 0.3% Y, the balance nickel and incidental impurities, onto flat plate-like substrates and pin-like substrates for environmental testing.

Similarly, a series of coatings, hereinafter referred to as the "6MYSi" or 6MYSi-type coatings by way of designation, was produced by low pressure plasma deposition of a 6MYSi-type alloy of the invention, i.e., one consisting essentially of, nominally by weight within normal melting tolerances, 4% Co, 8.5% Cr, 6% Al, S% Ta, 4.5% W, 1.5% Re, 1.5% Mo, 0.9% Hf, 0.01% B, 0.05% C, 0.3% Y and 1.0% Si, the balance nickel and incidental impurities, onto flat plate-like substrates and pin-like substrates for environmental testing.

A nickel-base superalloy capable of being cast as a single crystal by directional solidification and conforming to that described in copending, co-assigned patent application Ser. No. 307,819, filed Oct. 2, 1981, i.e., consisting essentially of, by weight, 7 to 12% Cr, 1 to 5% Mo, 3 to 5% Ti, 3 to 5% Al, 5 to 15% Co, 3 to W, Z to 6% Ta, up to 10% Re, up to 2% Cb, up to 3% V, up to Hf, balance nickel and incidental impurities, further characterized by the substantial absence of C, B, and Zr and wherein the Al:Ti ratio is maintained in the range of about 0.5 to about 1 while maintaining the Cr:AI ratio in the range of about 1.5 to 4 was used as the substrate and is hereinafter referred to as the "N" or N-type substrate for purposes of designation. More specifically, the composition of the substrate material was, nominally, by weight, 9.3% Cr, 7.5% Co, 3.7% Al, 4% Ta, 4.2% Ti, 1.5% Mo, 6%W, 0.5% Nb, the balance nickel plus incidental impurities.

For comparison, separate substrates of the above-described N-type were also provided with a coating typically used heretofore to enhance the resistance of such substrates to environmental degradation. In this case, the coating material selected was a NiCoCrAlY (Ni-23Co-18Cr-12.5Al -0.3Y) of the type described in U.S. Pat. No. 3,928,026%, which patent is herein incorporated by reference. All coatings of the NiCoCrAlY type were deposited by a commercial vendor using the physical vapor deposition (PVD) process described in the aforementioned U.S. Pat. No. 3,928,026.

Prior to coating deposition, the N-type substrates were solution treated at 310° F. for two hours irrespective of the coating to be applied. The process of applying the NiCoCrAlY type coatings has been described above. The 6MY and 6MYSi coatings were applied by the above-described LPPD plasma spray process using a commercially available standard external feed plasma spray gun and the process parameters of Table III.

TABLE III

LPPD PLASMA SPRAY PROCESS PARAMETERS (6MY and 6MYSi COATINGS ON N-TYPE SUBSTRATES)

| | |
|---|---|
| Gun-to-Substrate Distance | 12-15 inches |

TABLE III-continued

LPPD PLASMA SPRAY PROCESS PARAMETERS (6MY and 6MYSi COATINGS ON N-TYPE SUBSTRATES)

| | |
|---|---|
| Voltage | 50 volts nominal |
| Current | 800 amps nominal |
| Primary Gas/Rate | Argon/50 std. l./min. |
| Secondary Gas/Rate | Hydrogen/6 std. l./min. |
| Carrier Gas/Rate | Argon/1 std. l./min. |
| Powder Feed Rate | 10 lbs./hr. |
| Powder Size | −400 mesh (37μ) nominal |
| Chamber Pressure | 30-40 torr |

To optimize the properties of the substrates, all coated substrates were subjected to a post-deposition heat treatment which typically consisted of a first age at 1975° F. for 4 hours followed by a second age at 1650° F. for 16 hours. At this stage, the coatings are referred to as "as-deposited" coatings. The structure of the N-type substrate following the aging treatments is one of $\gamma'$ precipitates in a $\gamma$ matrix.

Table IV presents the results of cyclic oxidation tests on pin-like specimens conducted under the conditions shown in the table using a natural gas flame at the velocities shown in the table. The specimens were rotated for uniform exposure and cycled out of the flame once per hour to cool the specimens to about 800° F. Failure is defined as penetration of the coating to the extent that base metal (substrate) oxidation begins to occur. Hot corrosion testing was conducted at 1700° F. using a JP-5 fuel-fired flame with 5 ppm salt added to the combustion products. The specimens were rotated for uniform exposure and were cycled one of the flame once every hour.

TABLE IV

CYCLIC OXIDATION TESTS (N-TYPE SUBSTRATES)

| TEST CONDITIONS | COATING | TIME TO FAILURE (hrs) |
|---|---|---|
| 2075° F., Mach 1.0 | NiCoCrAlY | 500 |
| Gas Velocity, Cycled | 6M | 325 |
| to 800° F. once/hr | 6MY | 500 |
| | 6MYSi | 500 |
| 2150° F., Mach 1.0 | NiCoCrAlY | — |
| Gas Velocity, Cycled | 6M | 160 |
| to 800° F. once/hr | 6MY | 195 |
| | 6MYSi | 195 |

In the above-identified and cross-referenced application, "Nickel-Base Superalloys Especially Useful as Compatible Protective Environmental Coatings for Advanced Superalloys, " filed concurrently herewith, the invention of truely compatible superalloy coatings for eutectic and single crystal nickel-base superalloys (6M-type) was disclosed and claimed. As evidenced, for example, by the small interaction zones formed between the 6M-type coat1n% and substrates of eutectic and N-type nickel-base superalloys, the 6M-type coatings were physically and chemically compatible with those superalloy substrates. It has now been discovered that the addition of carefully controlled amounts of yttrium or mixtures of yttrium and silicon markedly improve upon the otherwise excellent oxidation resistance of the 6M-type alloys without adversely affecting the physical and chemical compatibility of those alloys with nickel-base superalloy substrates. The data of Table IV show that with the addition of yttrium or yttrium plus silicon, the resistance of the alloys of this invention to oxidation is improved over that of the 6M-type alloys, by about 50% and 20% at 2075° F. and 2150° F., respectively, and is about the same as that of the base-line NiCoCrAlY coating. In the hot corrossion tests, on N-type substrates, the 6MY and 6MYSi coatings had lives of about 785 and 1000 hours, respectively. Thus, it was discovered that the Si-containing 6MYSi coating had a life about 40% greater than that of the 6MY coating. Although having lower resistance to hot corrosion than NiCoCrAlY, the alloys of the invention as coatings provide acceptable hot corrosion protection.

The coated specimens were evaluated metallographically to determine the extent of interaction between the coatings and the substrates. The results are given in Table V which lists the extent, if any, of the denuded and platelet formation zones, the sum of which comprise the interaction zone, following exposure in the oxidation tests at the temperatures and for the times shown. Denuded zones in N-type substrates are zones which have been depleted of $\gamma'$ due to the diffusion of elements from the substrate to the coating, leaving a weakened, primarily $\gamma'$ matrix. Platelets, when formed, are a result of the interdiffusion of elements between the coating and the substrates, i.e., are evidence of a chemical incompatibility between the coating and the substrate.

Figure 4:
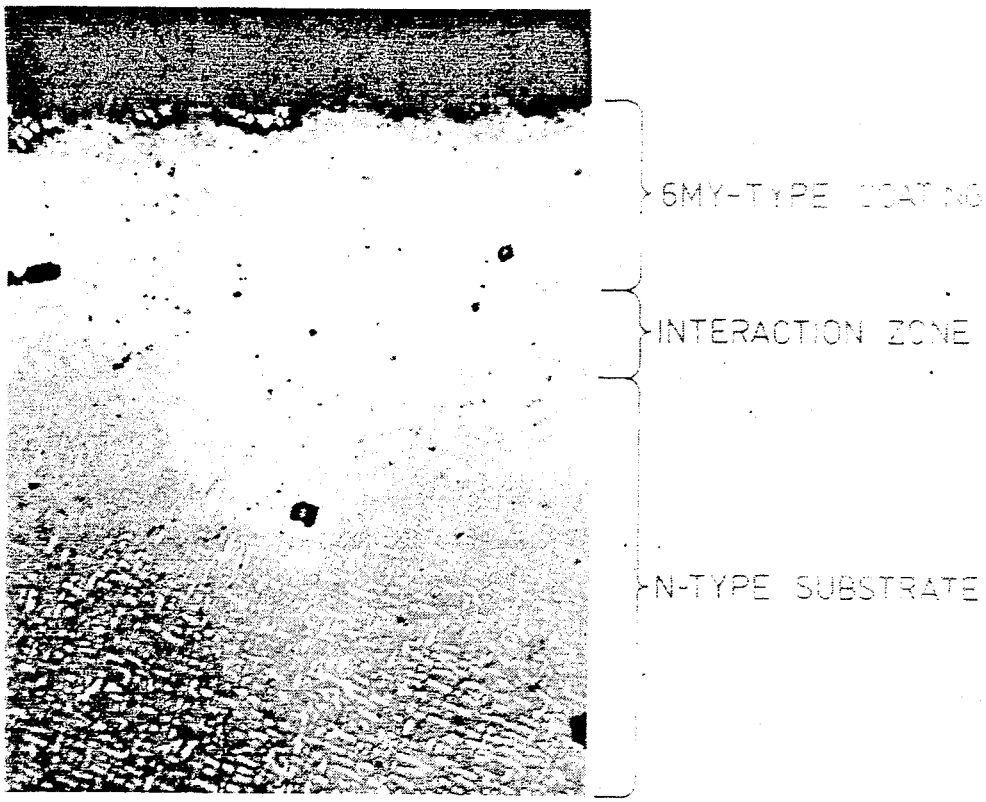
FIG. 4 is a photomicrograph at 300X of the 6MY alloy of the invention on an N-type substrate after exposure of 511 hours at 2075° F. in an oxidation test.
Figure 5:
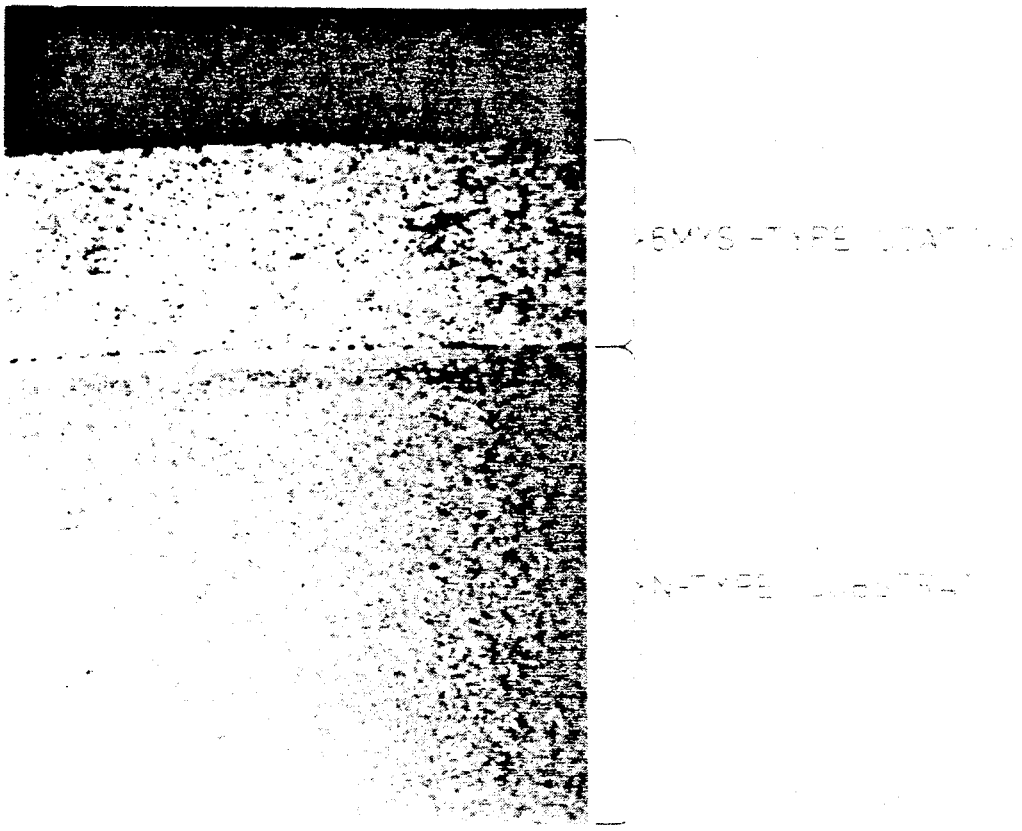
FIG. 5 is a photomicrograph at 300X of the 6MYSi alloy of the invention as-deposited as a coating on an N-type substrate by the LPPD process.

Reference to FIGS. 4 and 5 show that in the as-deposited condition there is virtually no interaction zone formed between the 6MY and 6MYSi-type coatings and the N-type substrate. A slight interaction zone, however, is evident in FIG. 1 between the NiCoCrAlY coating and the N-type substrate.

Figure 2:
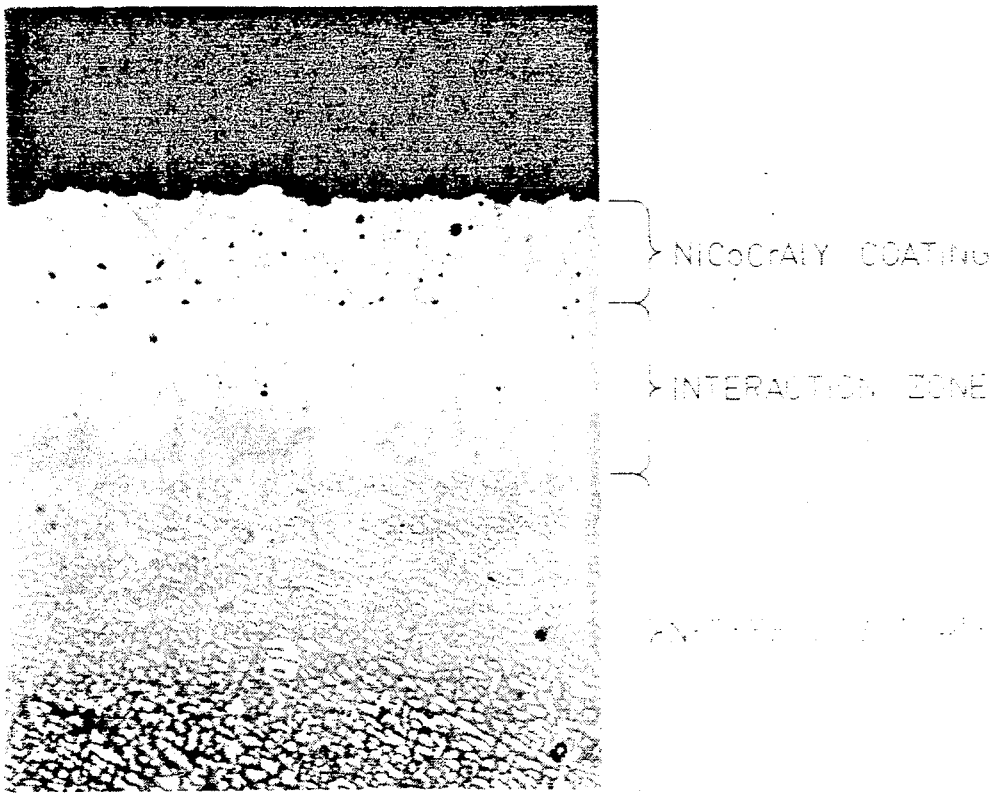
FIG. 2 is a photomicrograph at 300X of a NiCoCrAlY type coating on an N-type substrate following exposure of 375 hours at 2075° F. in an oxidation test.
Figure 3:
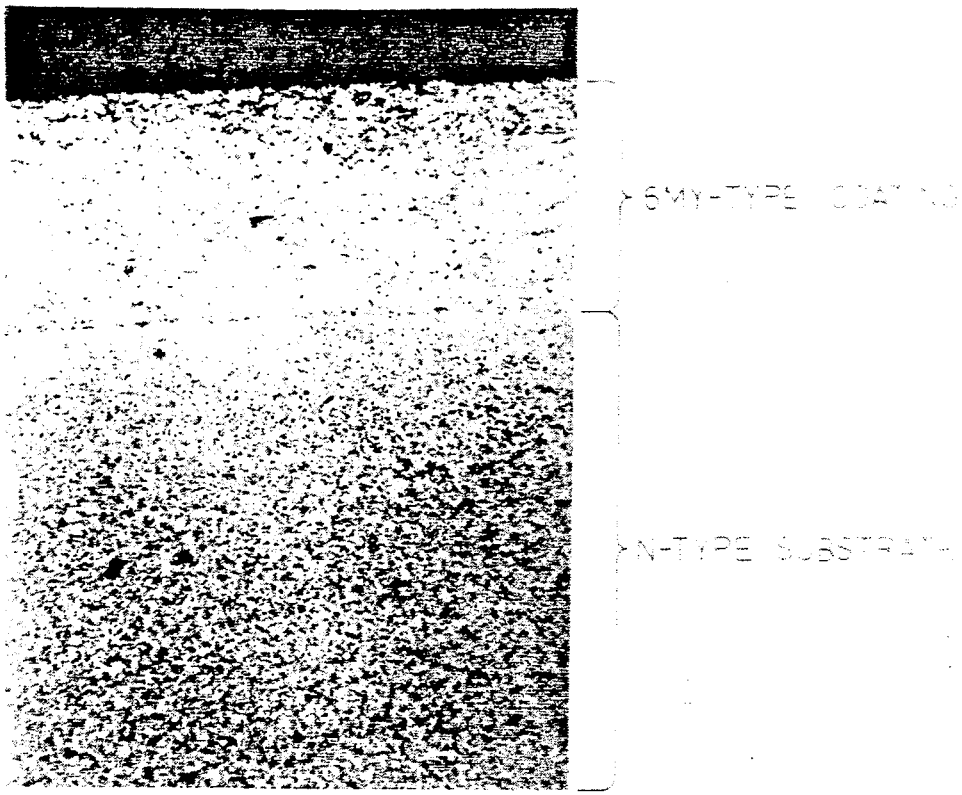
FIG. 3 is a photomicrograph at 30UX of the 6MY alloy of the invention as-deposited as a coating on an N-type substrate by the LPPD process.
Figure 6:
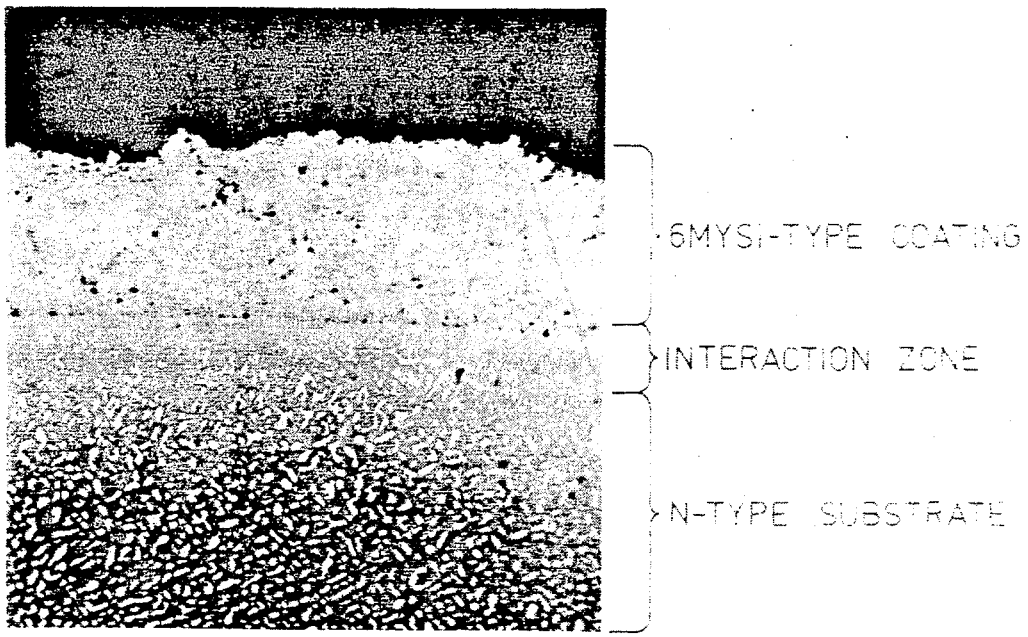
FIG. 6 is a photomicrograph at 300X of the 6MYSi alloy of the invention on an N-type substrate following exposure of 476 hours at 2075° F. in an oxidation test.

Reference to FIGS. 2, 4 and 6, and Table V, shows that after 375 hours exposure at 2075° F. in the oxidation test an interaction zone has formed between the NiCoCrAlY coating and the N-type substrate which is at least twice as deep as the interaction zone formed between the 6MY and 6MYSi-type coatings and the N-type substrate, even though the 6MY/N-type and 6MYSi/N-type pairs were tested for at least about a Z5% longer period of time.

TABLE V

AVERAGE DEPTH OF INTERACTION ZONE FOLLOWING OXIDATION TESTING

| COATING/ SUBSTRATE | EXPOSURE (hrs./°F.) | DENUDED (mils) | PLATELET (mils) | TOTAL (mils) |
|---|---|---|---|---|
| NiCoCrAlY/N | 375/2075 | 3.2 | 0 | 3.2 |
| 6MY/N | 511/2075 | 1.5 | 0 | 1.5 |
| 6MYSi/N | 476/2075 | 1.0 | 0 | 1.0 |

In addition to the unique combination of improved environmental resistance and reduced diffusional interaction, the alloys of the invention also possess high temperature strength superior to NiCoCrAlY. Elevated temperature tensile tests on very thick (~½ inch) deposits of the NiCoCrAlY, 6MY, and 6MYSi-type alloys showed that at 1800° F. the ultimate tensile strength (UTS) of the alloys was about 7, 38, and 41 ksi, respectively, while at 2000° F. the UTS of the alloys was about 3, 14 and 12 ksi, respectively. The high strengths of the alloys of the invention are expected to result in greatly improved resistance to thermal/mechanical fatigue cracking.

Since the alloys of the invention are themselves superalloys, the difference in the coefficient of thermal expansion ($\alpha$) between the alloys of the invention and nickel-base superalloy substrates are less than that between NiCoCrAlY and the same superalloy substrates. The smaller difference in $\alpha$ reduces the stresses imposed on a coating alloy in service and thereby reduces the propensity for coating spallation and thermal fatigue cracking.

Thus, the low propensity of the alloys of the invention to form interaction zones, and particularly their low propensity to form platelets, plus their high strength and thermal expansion compatibility with nickel-base superalloy substrates makes the alloys of the invention coatings which are truly chemically and physically compatible with nickel-base superalloy substrates in addition to providing the environmental resistance required in severe high pressure, high temperature turbine environments.

It has also been found that the novel alloys of this invention are useful as thicker, built-up deposits applied to selected regions of aircraft gas turbine engine components, such as the tip portions of rotating blades or stationary vanes, or for purposes of repairing nicked or damaged regions as typically occur on such components as airfoils. In this respect, the alloys of the invention are more in the nature of a superalloy from which components are made, e.g., structural or weight-carrying alloys, and less in the nature of coatings. The changes required in the plasma spraying process to effect the build-up of thicker deposits, as opposed to thin coatings, are well within the knowledge and expertise of those ordinarily skilled in the plasma spraying arts.

It will be understood that various changes and modifications not specifically referred to herein may be made in the invention herein described, and to its uses herein described, without departing from the spirit of the invention particularly as defined in the following claims.

What is desired to be secured by Letters Patent of the United States is the following.

We claim:

1. A coating composition for application to nickel-base superalloy substrates, said coating composition consisting essentially of, by weight, 1 to 10% cobalt, 6 to 12% chromium, 5 to 8% aluminum, 1 to 10% tantalum, 1 to 10% tungsten, 0 to 3% rhenium, 0 to 2% molybdenum, 0.1 to 2% hafnium, 0.005 to 0.1% boron, 0.005 to 0.25% carbon, 0.01 to 1.0% yttrium, the balance nickel and incidental impurities.

2. The coating composition of claim 1 consisting essentially of, by weight, 1 to 6% cobalt, 7 to 10% chromium, 5 to 7% aluminum, 4 to 6% tantalum, 3.5 to 5.5% tungsten, 0 to 3% rhenium, 0 to 2% molybdenum, 0.5 to 1.5% hafnium, 0.005 to 0.025% boron, 0.005 to 0.25% carbon, 0.05 to 0.5% yttrium, the balance nickel and incidental impurities.

3. The coating composition of claim 2 consisting essentially of, by weight, 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum, 0.7 to 1.1% hafnium, 0.005 to 0.02% boron, 0.005 to 0.2% carbon, 0.2 to 0.4% yttrium, the balance nickel and incidental impurities.

4. A coating composition for application to nickel-base superalloy substrates, said coating composition consisting essentially of, by weight, 1to 6% cobalt, 7 to 10% chromium, 5 to 7% aluminum, 4 to 6% tantalum, 3.5 to 5.5% tungsten, 0 to 3% rhenium, 0 to 2% molybdenum, 0.5 to 1.5% hafnium, 0.005 to 0.025% boron, 0.005 to 0.25% carbon, 0.05 to 0.5% yttrium, 0.5 to 1.5% silicon, the balance nickel and incidental impurities.

5. The coating composition of claim 4 consisting essentially of, by weight, 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum, 0.7 to 1.1% hafnium, 0.005 to 0.02% boron, 0.005 to 0.2% carbon, 0.2 to 0.4% yttrium, 0.8 to 1.2% silicon, the balance nickel and incidental impurities.

6. A composite article of manufacture comprising:

(i) a superalloy substrate selected from the group consisting of a nickel-base superalloy and nickel-base eutectic superalloy, and (ii) at least one thick, build-up regions integral with said substrate, said regions providing at least a portion of the outer surface of said article, the composition of said regions being that of claims 1, 2, or 3.

7. A composite article of manufacture comprising:

(i) a superalloy substrate selected from the group consisting of a nickel-base superalloy and nickel-base eutectic superalloy, and (ii) at least one thick, build-up regions integral with said substrate, said regions providing at least a portion of the outer surface of said article, the composition of said regions being that of claims 4 or 5.

8. The article of claim 6 wherein said substrate comprises an improved nickel-base superalloy capable of being cast as a single crystal by directional solidification consisting essentially of, by weight, 7 to 12% chromium, 1 to 5% molybdenum, 3 to 5% titanium, 3 to 5% aluminum, 5 to 15% cobalt, 3 to 12% tunsten, 2 to 6% tantalum, up to 10% rhenium, up to 2% columbium, up to 3% vanadium, up to 2% hafnium, balance nickel and incidental impurities, further characterized by the substantial absence of carbon, boron, and zirconium, the alloy having an Al:Ti ratio in the range of about 0.5 to about 1 while maintaining the Cr:Al ratio in the range of about 1.5 to 1.

9. The article of claim 8 wherein said substrate consists essentially of, by weight, about 9.3chromium, 7.5% cobalt, 3.7% aluminum, 4% tantalum, 4.2% titanium, 1.5% molybdenum, 6% tungsten, 0.5% niobium, the balance nickel and incidental impurities.

10. The article of claim 7 wherein said substrate comprises an improved nickel-base superalloy capable of being cast as a single crystal by directional solidification consisting essentially of, by weight, 7 to 12% chromium, 1 to 5% molybdenum, 3 to 5% titanium, 3 to 5% aluminum, 5 to 15% cobalt, 3 to 12% tungsten, 2 to 6% tantalum, up to 10% rhenium, up to 2% columbium, up to 3% vanadium, up to 2% hafnium, balance nickel and incidental impurities, further characterized by the substantial absence of carbon, boron, and zirconium, the alloy having an Al:Ti ratio in the range of about 0.5 to about 1 while maintaining the Cr:Al ratio in the range of about 1.5 to 4.

11. The article of claim 10 wherein said substrate consists essentially of, by weight, about 9.3% chromium, 7.5% cobalt, 3.7% aluminum, 4% tantalum, 4.2% titanium, 1.5% molybdenum, 6% tungsten, 0.5% niobium, the balance nickel and incidental impurities.

12. The article of claim 6 wherein said substrate is an aircraft gas turbine engine rotatable blade or stationary vane and said built-up region further comprises the tip portion thereof.

13. The article of claim 7 wherein said substrate is an aircraft gas turbine engine rotatable blade or stationary vane and said built-up region further comprised the tip portion thereof.

14. A superalloy article which comprises a substrate selected from the group consisting of a nickel-base superalloy and a nickel-base eutectic superalloy having applied to at least one surface an improved high temperature oxidation and corrosion resistant coating having the composition of claims 1, 2 or 3, the coated article further characterized by chemical compatibility between the coating and the substrate.

15. A superalloy article which comprises a substrate selected from the group consisting of a nickel-base superalloy and a nickel-base eutectic superalloy having applied to at least one surface an improved high temperature oxidation and corrosion resistant coating having the composition of claims 4 or 5, the coated article further characterized by chemical compatibility between the coating and the substrate.

16. The article of claim 14 wherein said substrate comprises an improved nickel-base superalloy capable of being cast as a single crystal by directional solidification consisting essentially of, by weight, 7 to 12% chromium, 1 to 5% molybdenum, 3 to 5% titanium, 3 to 5% aluminum, 5 to 15% cobalt, 3 to 12% tungsten, 2 to 6% tantalum, up to 10% rhenium, up to 2% columbium, up to 3% vanadium, up to 2% hafnium, the balance nickel and incidental impurities, further characterized by the substantial absence of carbon, boron and zirconium, the alloy having an Al:Ti ratio in the range of about 0.5 to 1 while maintaining the Cr:Al ratio in the range of about 1.5 to 4.

17. The article of claim 16 wherein said substrate consists essentially of, by weight, about 9.3% chromium, 7.5% cobalt, 3.7% aluminum, 4% tantalum, 4.2% titanium, 1.5% molybdenum, 6% tungsten, 0.5% niobium, the balance nickel and incidental impurities.

18. The article of claim 15 wherein said substrate comprises an improved nickel-base superalloy capable of being cast as a single crystal by directional solidification consisting essentially of, by weight, 7 to 12% chromium, 1 to 5% molybdenum, 3 to 5% titanium, 3 to 5% aluminum, 5 to 15% cobalt, 3 to 12% tungsten, 2 to 6% tantalum, up to 10% rhenium, up to 2% columbian, up to 3% vanadium, up to 2% hafnium, the balance nickel and incidental impurities, further characterized by the substantial absence of carbon, boron and zirconium, the alloy having an Al:Ti ratio in the range of about 0.5 to about 1 while maintaining the Cr:Al ratio in the range of about 1.5 to 4.

19. The article of claim 18 wherein said substrate consists essentially of, by weight, about 9.3% chromium, 7.5% cobalt, 3.7% aluminum, 4% tantalum, 4.2% titanium, 1.5% molybdenum, 6% tungsten, 0.5% niobium, the balance nickel and incidental impurities.

20. An article which comprises a single crystal, directionally solidified nickel-base superalloy substrate having on at least one surface an improved high temperature oxidation and corrosion resistant coating, the coating having a composition consisting essentially of, by weight, about 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum 0.7 to 1.1% hafnium, 0.005 to 0.02% boron, 0.005 to 0.2% carbon, 0.2 to 0.4% yttrium and the balance nickel and incidental impurities, the article further characterized by a low propensity to form interaction zones having depleted gamma prime at the coating-substrate interface at elevated temperatures.

21. An article which comprises a single crystal, directionally solidified nickel-base superalloy substrate having on at least one surface an improved high temperature oxidation and corrosion resistant coating, the coating having a composition consisting essentially of, by weight, about 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum, 0.7 to 1.1% hafnium, 0.005 to 0.02% boron, 0.005 to 0.2% carbon, 0.2 to 0.4% yttrium, and the balance nickel and incidental impurities, the article further characterized by a low propensity to form platelets due to elemental diffusion at the coating-substrate interface of elevated temperatures.

22. An article which comprises a single crystal, directionally solidified nickel-base superalloy substrate having on at least one surface an improved high temperature oxidation and corrosion resistant coating, the coating having a composition consisting essentially of, by weight, about 3.8 to 4.2% cobalt, 8.3 to 8.7% chromium, 5.8 to 6.2% aluminum, 4.7 to 5.3% tantalum, 4.2 to 4.8% tunsten, 1.2 to 1.8% rhenium, 1.3 to 1.7% molybdenum, 0.7 to 1.1% hafnium, 0.005 to 0.02% boron, 0.005 to 0.2% carbon, 0.2 to 0.4% yttrium, 0.8 to 1.2% silicon and the balance nickel and incidental impurities, the article further characterized by a low propensity to form interaction zones having depleted gamma prime at the coating-substrate interface at elevated temperatures.

23. An article which comprises a single crystal, directionally solidified nickel-base superalloy substrate having on at least one surface an improved high temperature oxidation and corrosion resistant coating, the coating having a composition consisting essentially of, by weight, about 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum, 0.7 to 1.1% hafnium, 0.005 to 0.02% boron, 0.005 to 0.2% carbon, 0.2 to 0.4% yttrium, 0.8 to 1.2% silicon and the balance nickel and incidental impurities, the article further characterized by a low propensity to form platelets due to elemental diffusion at the coating-substrate interface at elevated temperatures.

* * * * *

UNITED STATES PATENT AND TRADEMARK OFFICE

CERTIFICATE OF CORRECTION

PATENT NO. : 5,043,138

DATED : August 27, 1991

INVENTOR(S) : RAMGOPAL DAROLIA and EDWARD H. GOLDMAN

It is certified that error appears in the above-identified patent and that said Letters Patent is hereby corrected as shown below:

Column 1, line 10, delete "," after "continuation".

Column 1, line 13, insert --,-- after "1983".

Column 3, line 1, insert --12%-- before "chromium".

Column 3, line 33, replace "30 UX" with --300X--.

Column 4, line 17, replace "Table I" with --Table II--.

Column 5, line 23, replace "S%" with --5%--.

Column 5, line 38, replace "Cr:AI" with --Cr:Al--.

Column 5, line 51, delete "%" after "3,928,026".

Column 5, line 57, replace "310°F" with --2310°F--.

Column 6, line 51, replace "truely" with --truly--.

Column 6, line 55, replace "coatln%" with --coating--.

Column 7, line 8, replace "NiCoCrAIY" with --NiCoCrAlY--.

Column 7, line 29, replace "NiCoCrAIY" with --NiCoCrAlY.

Column 7, line 39, replace "Z5%" with --25%--.

Column 8, line 62, replace "1to 6%" with -- 1 to 6% --.

UNITED STATES PATENT AND TRADEMARK OFFICE

CERTIFICATE OF CORRECTION

PATENT NO. : 5,043,138

DATED : August 27, 1991

INVENTOR(S) : RAMGOPAL DAROLIA and EDWARD H. GOLDMAN

It is certified that error appears in the above-indentified patent and that said Letters Patent is hereby corrected as shown below:

Column 9, line 41, insert --%-- after "9.3".

In addition the certificate of correction to issue will show col. 7, line 25, "4" should read --3--.

Signed and Sealed this

Eighth Day of June, 1993

Attest:

Michael K. Kirk

MICHAEL K. KIRK

Attesting Officer

Acting Commissioner of Patents and Trademarks